US005597795A

United States Patent [19]

Fredj et al.

[11] Patent Number: 5,597,795

[45] Date of Patent: Jan. 28, 1997

[54] DETERGENT COMPOSITIONS INHIBITING DYE TRANSFER

[75] Inventors: Abdennaceur Fredj, Brussels; James P. Johnston, Overijse; Regine Labeque, Brussels; Christiaan A. Thoen, Haasdonk, all of Belgium

[73] Assignee: The Procter & Gamble Company, Cincinnati, Ohio

[21] Appl. No.: 416,678

[22] PCT Filed: Oct. 15, 1993

[86] PCT No.: PCT/US93/09936

§ 371 Date: Apr. 7, 1995

§ 102(e) Date: Apr. 7, 1995

[87] PCT Pub. No.: WO94/10277

PCT Pub. Date: May 11, 1994

[30] Foreign Application Priority Data

Oct. 27, 1992 [EP] European Pat. Off. ..... 92203287

[51] Int. Cl.[6] ..... C11D 3/37; C11D 3/30

[52] U.S. Cl. ..... 510/528; 510/299; 510/337

[58] Field of Search ..... 252/174.12, DIG. 12, 252/547, 174.23, 174.24, 544, 174.21

[56] References Cited

U.S. PATENT DOCUMENTS

| | | | |
|---|---|---|---|
| 3,159,611 | 12/1964 | Dunn et al. | 260/88.3 |
| 4,548,744 | 10/1985 | Connor et al. | 252/545 |
| 5,009,980 | 4/1991 | El-Sayed et al. | 430/114 |
| 5,298,289 | 3/1994 | Lindert et al. | 227/388.4 |
| 5,451,341 | 9/1995 | White | 252/547 |
| 5,458,809 | 10/1995 | Fredj et al. | 252/542 |
| 5,458,810 | 10/1995 | Fredj et al. | 252/542 |
| 5,460,752 | 10/1995 | Fredj et al. | 252/542 |

FOREIGN PATENT DOCUMENTS

| | | | |
|---|---|---|---|
| 0199403 | 10/1986 | European Pat. Off. . | |
| 0241984 | 10/1987 | European Pat. Off. . | |
| 0241985 | 10/1987 | European Pat. Off. . | |
| 0265257A2 | 4/1988 | European Pat. Off. | C11D 3/37 |
| 0508034A1 | 10/1992 | European Pat. Off. | C11D 3/37 |
| 0579295 | 1/1994 | European Pat. Off. . | |
| 0581751 | 2/1994 | European Pat. Off. . | |
| 0581752 | 2/1994 | European Pat. Off. . | |
| 0581753 | 2/1994 | European Pat. Off. . | |
| 0635563 | 1/1995 | European Pat. Off. . | |
| 2814329 | 10/1979 | Germany | C11D 3/28 |
| 3840056 | 5/1990 | Germany . | |
| 1348212 | 3/1974 | United Kingdom | C11D 3/28 |
| 2137221 | 10/1984 | United Kingdom | C11D 10/02 |
| WO94/02579 | 2/1994 | WIPO | C11D 3/00 |
| WO94/02580 | 2/1994 | WIPO | C11D 3/00 |
| WO94/02581 | 2/1994 | WIPO | C11D 3/0084 |
| WO94/11473 | 5/1994 | WIPO | C11D 1/04 |

OTHER PUBLICATIONS

U.S. application Ser. No. 08/320,350, Wertz and Panandiker, filing date: Oct. 11, 1994.

U.S. application Ser. No. 08/150,644, Panandiker, Wertz and Hughes, filing date: Nov. 10, 1993.

U.S. application Ser. No. 08/119,922, White, filing date: Sep. 10, 1993.

*Primary Examiner*—Paul Lieberman
*Assistant Examiner*—Kery A. Fries
*Attorney, Agent, or Firm*—George W. Allen

[57] ABSTRACT

The present invention relates to a inhibiting dye transfer composition comprising Polyamine N-oxide containing polymers and terephthalate polymers.

6 Claims, No Drawings

DETERGENT COMPOSITIONS INHIBITING DYE TRANSFER

FIELD OF THE INVENTION

The present invention relates to a composition and a process for inhibiting dye transfer between fabrics during washing.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to complex or absorb the fugitive dyes washed out of dyed fabrics before they have the opportunity to become attached to other articles in the wash. Polymers have been used within detergent compositions to inhibit dye transfer, such as EP-A-O 102 923, DE-A-2 814 329, FR-A-2 144 721 and EP-265 257.

Copending EP Patent Application 92202168.8 describes dye transfer inhibiting compostions comprising polyamine N-oxides containing polymers.

In addition to dye binding, it is also important to prevent the tendency of some coloured fabrics to release dyes into the wash solution. It has now been found that terephthalate-based soil release polymers when added to said polyamine N-oxide dye transfer inhibiting compositions enhance the overall dye transfer inhibiting performance.

This finding allows the formulation of detergent compositions which are very efficient in preventing colour-bleeding and in eliminating transfer of solubilized or suspended dyes.

According to another embodiment of this invention a process is also provided for laundering operations involving colored fabrics.

Terephthalate-based soil release polymers have also been described in the art, for instance in GB 2 137 221, U.S. Pat. No. 4,116,885, U.S. Pat. No. 132,680, EP 185 427, EP 199 403, EP 241 985 and EP 241 984.

SUMMARY OF THE INVENTION

The present invention relates to inhibiting dye transfer compositions comprising.

A) polyamine N-oxide polymers.

B) terephthalate-based polymers.

DETAILED DESCRIPTION OF THE INVENTION

The compositions of the present invention comprise as essential elements polyamine N-oxide polymers (A) and a terephtalate-based polymer (B).

(A) Polyamine N-oxide polymers

The polyamine N-oxide polymers contain units having the following structure formula:

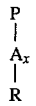

wherein

P is a polymerisable unit, whereto the N—O group can be attached to or wherein the N—O group forms part of the polymerisable unit or a combination of both.

A is

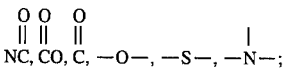

x is or 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups The N—O group can be represented by the following general structures:

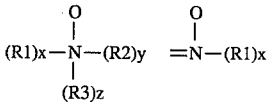

wherein

R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 3:1 to 1:1000000. The polymers of the present invention actually encompass random or block copolymers where one monomer type is an amine N-oxide and the other monomer type is an N-oxide or not.

The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired water-solubility and dye-suspending power.

Typically, the average molecular weight is within the range of 500 to 1000,000; more preferred 1000 to 500,000; most preferred 5000 to 100,000.

The polyamine N-oxides of the present invention are typically present from 0.01 to 10%, more preferably from 0.05 to 1%, most preferred from 0.05 to 0.5% by weight of the dye transfer inhibiting composition.

(B) Terephthalate-based soil release polymers

It has now surprisingly been found that the overall dye transfer inhibiting performance of detergent compositions comprising polyamine N-oxide polymers can be improved by adding terephtalate-based soil release polymers.

It is believed that the adsorption capacity of terephtalate-based soil release polymers onto the fabrics is improved by the polyamine N-oxide polymers. As a result, the soil release polymer adsorbs better onto the surface of the fabrics immersed in the wash solution. It is also believed that the backbone structure is important to the adsorption of the polymers on the fabrics while the end groups confer the soil release properties. The adsorbed polyester then forms a film onto the fabrics which prevents the fabric from bleeding. The said combination of terephthalate-base polymers and polyamine N-oxide containing polymers allows us to formulate dye transfer inhibiting compositions which are very efficient in preventing colour-bleeding and in eliminating transfer of solubilized or suspended dyes.

The compositions according to the present invention comprise from 0.01% to 10% by weight of the total dye transfer inhibiting composition, preferably from 0.05% to 5% of a terephthalate-based soil release polymer. Such soil release polymers have been extensively described in the art, for instance in U.S. Pat. No. 4,116,885, U.S. Pat. No. 4,132,680, EP 185 427, EP 199 403, EP 241 985 and EP 241 984.

Suitable polymers for use herein include polymers of the formula:

$$X-[(OCH_2CH(Y))_n(OR^5)_m]-[A-R^1-A-R^2)_u(A-R^3-A-R^2)_v]-$$

$$-A-R^4-A-[(R^5O)_m(CH(Y)CH_2O)_n]-X$$

In this formula, the moiety $-[(A-R^1-A-R^2)_u(A-R^3-A-R^2)_v]-A-R^4-A$ forms the oligomer or polymer backbone of the compounds.

The linking A moieties are essentially $$-\overset{O}{\overset{\|}{C}}O- \quad \text{or} \quad -O\overset{O}{\overset{\|}{C}}-$$

moieties,i.e. the compounds of the present invention are polyesters. As used herein, the term "the A moieties are essentially $$-\overset{O}{\overset{\|}{C}}O- \quad \text{or} \quad -C\overset{O}{\overset{\|}{O}}-$$

moieties" refers to compounds where the A moieties consist entirely of moieties —OC— or —CO—, $$-\overset{O}{\overset{\|}{C}}O- \quad \text{or} \quad -C\overset{O}{\overset{\|}{O}}-,$$

or are partially substituted with linking moieties such as $$-\underset{\underset{H}{|}}{\overset{O}{\overset{\|}{N}}}C- \quad \text{or} \quad \underset{\underset{H}{|}}{\overset{O}{\overset{\|}{C}}}N-\text{(amide)}, \quad \text{and} \quad -O\underset{\underset{H}{|}}{\overset{O}{\overset{\|}{C}}}N- \quad \text{or}$$

$$-\underset{\underset{H}{|}}{\overset{O}{\overset{\|}{N}}}CO-\text{(urethane)}.$$

The degree of partial substitution with these other linking moieties should be such that the soil release properties are not adversely affected to any great extent. Preferably, linking moieties A consist entirely of (i.e., comprise 100%) moieties $$-\overset{O}{\overset{\|}{C}}O- \quad \text{or} \quad -C\overset{O}{\overset{\|}{O}}-,$$

i.e., each A is either $$-\overset{O}{\overset{\|}{C}}O- \quad \text{or} \quad -C\overset{O}{\overset{\|}{O}}-$$

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof, Arylene and alkarylene moieties which can be partially substituted for 1,4-phenylene include 1,3-phenylene, 1,2-phenylene, 1,8-naphthylene, 1,4-naphthylene, 2,2-biphenylene, 4,4'-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50 to 100% 1,4-phenylene moieties (from 0 to about 50% moieties other than 1,4-phenylene) have adequate soil release activity. For example, polyesters made according to the present invention with a 40:60 mole ratio of isophthalic(1,3-phenylene) to terephthalic(1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e. each $R^1$ moiety is 1,4-phenylene.

The $R^2$ moieties are essentially ethylene moieties, or substituted ethylene moieties having $C_1$–$C_4$ alkyl or alkoxy substitutents. As used herein, the term "the $R^2$ moieties are essentially ethylene moieties, or substituted ethylene moieties having $C_1$–$C_4$ alkyl or alkoxy substituents" refers to compounds of the present invention where the $R^2$ moieties consist entirely of ethylene, or substituted ethylene moieties, or are partially substituted with other compatible moieties. Examples of these other moieties include linear $C_3$–$C_6$ alkylene moieties such as 1,3-propylene, 1,4-butylene, 1,5-pentylene or 1,6-hexamethylene, 1,2-cycloalkylene moieties such as 1,2-cyclohexylene, 1,4-cycloalkylene moieties such as 1,4-cyclohexylene and 1,4-dimethylenecyclohexylene, polyoxyalkylated 1,2-hydroxyalkylenes such as $$-CH_2-\underset{\underset{CH_2-O(CH_2CH_2O)_p-X}{|}}{CH}-,$$

and oxyalkylene moieties such as $-CH_2CH_2OCH_2CH_2OCH_2CH_2-$ or $-CH_2CH_2OCH_2CH_2-$.

For the $R^2$ moieties, the degree of partial substitution with these other moieties should be such that the soil release properties of the compounds are not adversely affected to any great extent. Generally, the degree of partial substitution which can be tolerated will depend upon the backbone length of the compound, i.e., longer backbones can have greater partial substitution. Usually, compounds where the $R^2$ comprise from about 20 to 100% ethylene, or substituted ethylene moieties (from 0 to about 80% other compatible moieties) have adequate soil release activity. For example, polyesters made according to the present invention with a 75:25 mole ratio of diethylene glycol ($-CH_2CH_2OCH_2CH_2-$) to ethylene glycol (ethylene) have adequate soil release activity. However, it is desirable to minimize such partial substitution, especially with oxyalkylene moieties, for best soil release activity. (During the making of polyesters according to the present invention, small amounts of these oxyalkylene moieties (as dialkylene glycols) are typically formed from glycols in side reactions and are then incorporated into the polyester). Preferably, $R^2$ comprises from about 80 to 100% ethylene, or substituted ethylene moieties, and from 0 to about 20% other compatible moieties.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixtures thereof. Inclusion of a greater percentage of ethylene moieties tends to improve the soil release activity of the compounds. Surprisingly, inclusion of a greater percentage of 1,2-propylene moieties tends to improve the water solubility of the compounds.

For the $R^3$ moieties, suitable substituted $C_2$–$C_{18}$ hydrocarbylene moieties can include substituted $C_2$–$C_{12}$ alkylene, alkenylene, arylene, alkarylene and like moieties. The substituted alkylene or alkenylene moieties can be linear, branched, or cyclic. Also, the $R^3$ moieties can be all the same (e.g. all substituted arylene) or a mixture (e.g. a mixture of substituted arylenes and substituted alkylenes). Preferred. $R^3$ moieties are those which are substituted 1,3-phenylene moieties.

The substituted $R^3$ moieties preferably have only one $-SO_3M$, $-COOM$, $-O-[(R^5O)_m(CH(Y)CH_2O)_n]-X$ or $-A-[(R^2-A-R^4-A)]_w-[R^5O)_m(CH(Y)CH_2O)_n]-X$ substituent. M can be H or any compatible water-soluble cation. Suitable water soluble cations include the water soluble alkali metals such as potassium ($K^+$) and especially sodium ($Na^+$), as well as ammonium ($NH_4^+$). Also suitable are substituted ammonium cations having the formula:

$$R^2-\overset{\overset{R^1}{|}}{\underset{\underset{R^3}{|}}{N^+}}-R^4$$

where $R^1$ and $R^2$ are each a $C_1$–$C_{20}$ hydrocarbyl group (e.g. alkyl, hydroxyalkyl) or together form a cyclic or heterocyclic ring of from 4 to 6 carbon atoms (e.g. piperidine, morpholine); $R^3$ is a $C_1$–$C_{20}$ hydrocarbyl group; and $R^4$ is H (ammonium) or a $C_1$–$C_{20}$ hydrocarbyl group (quat amine). Typical substituted ammonium cationic groups are those where $R^4$ is H (ammonium) or $C_1$–$C_4$ alkyl, especially methyl (quat amine); $R^1$ is $C_{10}$–$C_{18}$ alkyl, especially $C_{12}$–$C_{14}$ alkyl; and $R^2$ and $R^3$ are each $C_1$–$C_4$ alkyl, especially methyl.

The $R^3$ moieties having $-A-[(R^2-A-R^4A)]_w-[(R^5O)_m(CH(Y)CH_2O)_n]-X$ substituents provide branched backbone compounds. $R^3$ moieties having $-A-[(R^2-A-R^4-A)]_wR^2-A$ moieties provide crosslinked backbone compounds. Indeed, syntheses used to make the branched backbone compounds typically provide at least some crosslinked backbone compounds.

The moieties $-(R^5O)-$ and $-(CH(Y)CH_2O)-$ of the moieties $-[(R^5O)_m(CH(Y)CH_2O)_n]-$ and $-[(OCH(Y)CH_2)_n(OR^5)_m]-$ can be mixed together or preferably form blocks of $-(R^5O)-$ and $-(CH(Y)CH_2O)-$ moieties. Preferably, the blocks of $-(R^5O)-$ moieties are located next to the backbone of the compound. When $R^5$ is the moiety $-R^2-A-R^6-$, m is 1; also the moiety $-R^2-A-R^6-$ is preferably located next to the backbone of the compound. For $R^5$, the preferred $C_3$–$C_4$ alkylene is $C_3H_6$ (propylene); when $R^5$ is $C_3$–$C_4$ alkylene, m is preferably from 0 to about 5 and is most preferably 0. $R^6$ is preferably methylene or 1,4-phenylene. The moiety $-(CH(Y)CH_2O)-$ preferably comprises at least about 75% by weight of the moiety $-[(R^5O)_m(CH(Y)CH_2O)_n]-$ and most preferably 100% by weight (m is 0).

The Y substituents of each moiety $-[(R^5O)_m(CH(Y)CH_2O)_n]-$ are the ether moiety $-CH_2(OCH_2CH_2)_pO-X$, or are, more typically, a mixture of this ether moiety and H; p can range from 0 to 100, but is typically 0. When the Y substituents are a mixture, moiety $-(CH(Y)CH_2O)_n-$ can be represented by the following moiety:

$$[(\underset{\underset{CH_2(OCH_2CH_2)_pO-X}{|}}{CHCH_2O})_{n_1}(CH_2CH_2O)_{n_2}]$$

wherein $n_1$ is at least 1 and the sum of $n_1+n_2$ is the value for n. Typically, $n_1$ has an average value of from about 1 to about 10. The moieties $$-(\underset{\underset{CH_2(OCH_2CH_2)_pO-X}{|}}{CHCH_2O})_{n_1}- \quad \text{and} \quad -(CH_2CH_2O)_{n_2}-$$

can be mixed together, but typically form blocks of $$-(\underset{\underset{CH_2(OCH_2CH_2)_pO-X}{|}}{CHCH_2O})_{n_1}- \quad \text{and} \quad -(CH_2CH_2O)_{n_2}\text{-moieties.}$$

X can be H, $C_1$–$C_4$ alkyl or $$-\overset{O}{\overset{||}{C}}R^7,$$

wherein $R^7$ is $C_1$–$C_4$ alkyl. X is preferably methyl or ethyl, and most preferably methyl. The value for each n is at least about 6, but is preferably at least about 10. The value for each n usually ranges from about 12 to about 113. Typically, the value for each n is in the range of from about 12 to about 43.

The backbone moieties $-(A-R^1-A-R^2)-$ and $-(-A-R^3-A-R^2)-$ can be mixed together or can form blocks of $-(A-R^1-A-R^2)-$ and $-(A-R^3-A-R^2)-$ moieties. It has been found that the value of u+v needs to be at least about 3 in order for the compounds of the present invention to have significant soil release activity. The maximum value for u+v is generally determined by the process by which the compound is made, but can range up to about 25, i.e. the compounds of the present invention are oligomers or low molecular weight polymers. By comparison, polyesters used in fiber making typically have a much higher molecular weight, e.g. have from about 50 to about 250 ethylene terephthalate units. Typically, the sum of u+v ranges from about 3 to about 10 for the compounds of the present invention.

Generally, the larger the u+v value, the less soluble is the compound, especially when the $R^3$ moieties do not have the substituents —COOM or $—SO_3M$. Also, as the value for n increases, the value for u+v should be increased so that the compound will deposit better on the fabric during laundering. When the $R^3$ moieties have the substituent $—A-[(R^2—A—R^4—A)]_w-[(R^5O)_m(CH(Y)CH_2O)_n]X$ (branched backbone compounds) or $—A-[(R^2—A—R^4—A)]_wR^2—A—$ (crosslinked backbone compounds), the value for w is typically at least 1 and is determined by the process by which the compound is made. For these branched and crosslinked backbone compounds the value for u+v+w is from about 3 to about 25.

Preferred compounds in this class of polymers are block polyesters having the formula:

$$X+(OCH_2CH_2)_{n_2}(\underset{\underset{CH_2OX}{|}}{OCH_2CH})_{n_1}+(\overset{O}{\overset{||}{C}}O-R^1-\overset{O}{\overset{||}{C}}O-R^2)_u(-\overset{O}{\overset{||}{C}}O-R^3-\overset{O}{\overset{||}{C}}O-R^2)_v+\overset{O}{\overset{||}{C}}O-R^4-\overset{O}{\overset{||}{C}}O+(\underset{\underset{CH_2OX}{|}}{CHCH_2O})_{n_1}(CH_2CH_2O)_{n_2}+X$$

wherein the $R^1$ moieties are all 1,4-phenylene moieties; the $R^2$ moieties are essentially ethylene moieties, 1,2-propylene moieties or mixtures thereof; the $R^3$ moieties are all potassium or preferrably sodium 5-sulfo-1,3-phenylene moieties or substituted 1,3-phenylene moieties having the substituent $$-\overset{O}{\overset{||}{C}}O+(R^2-\overset{O}{\overset{||}{C}}O-R^4-\overset{O}{\overset{||}{C}}O)_w+(\underset{\underset{CH_2OX}{|}}{CHCH_2O})_{n_1}(CH_2CH_2O)_{n_2}+X$$

at the 5 position; the $R^4$ moieties are $R^1$ or $R^3$ moieties, or mixtures thereof; each X is ethyl or preferably methyl; each $n_1$ is from 1 to about 5; the sum of each $n_1+n_2$ is from about 12 to about 43; when w is 0, u+v is from about 3 to about 10; when w is at least 1, u+v+w is from about 3 to about 10.

Particularly preferred block polyesters are those where v is 0, i.e. the linear block polyesters. For these most preferred linear block polyesters, u typically ranges from about 3 to about 8. The most water soluble of these linear block polyesters are those where u is from about 3 to about 5.

Other suitable polymers for use herein include polymers of the formula:

$$X+(OCH_2CH(Y))_n(OR^4)_m+-+(A-R^1-A-R^2)_u(A-R^1-A-R^3)_v+$$

$$-A-R^1-A+(R^4O)_m(CH(Y)CH_2O)_n+X$$

In this formula, the moiety $-[(A—R^1—A—R^2)_u(A—R^1—A—R^3)_v]A—R^1—A—$ forms the oligomer or polymer backbone of the compounds. Groups $X-[(OCH_2CH(Y))_n(OR^4)_m]-$ and $-[(R^4O)_m(CH(Y)CH_2O)_n]X$ are generally connected at the ends of the oligomer/polymer backbone.

The linking A moieties are essentially $$-\overset{O}{\overset{||}{C}}O- \quad \text{or} \quad -\overset{O}{\overset{||}{O}}C-$$

moieties, i.e. the compounds of the present invention are polyesters. As used herein, the term "the A moieties are essentially $$-\overset{O}{\overset{||}{O}}C- \quad \text{or} \quad -\overset{O}{\overset{||}{C}}O-$$

moieties" refers to compounds where the A moieties consist entirely of moieties $$-\overset{O}{\overset{||}{O}}C- \quad \text{or} \quad -\overset{O}{\overset{||}{C}}O-,$$

or are partially substituted with linking moieties such as $$-\overset{O}{\overset{||}{N}}\underset{\underset{H}{|}}{C}- \quad \text{or} \quad \underset{\underset{H}{|}}{N}\overset{O}{\overset{||}{C}}\text{-(amide), and}$$

$$-\overset{O}{\overset{||}{O}}\underset{\underset{H}{|}}{C}N- \quad \text{or} \quad -\overset{O}{\overset{||}{N}}\underset{\underset{H}{|}}{C}O\text{-(urethane).}$$

The degree of partial substitution with these other linking moieties should be such that the soil release properties are not adversely affected to any great extent. Preferably, linking moieties A consist entirely of (i.e., comprise 100%) moieties $$-\overset{O}{\overset{\|}{C}}O- \quad \text{or} \quad -\overset{O}{\overset{\|}{C}}O-,$$

i.e., each A is either $$-\overset{O}{\overset{\|}{C}}O- \quad \text{or} \quad -\overset{O}{\overset{\|}{C}}O-$$

The $R^1$ moieties are essentially 1,4-phenylene moieties. As used herein, the tern "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene 1,8-naphthylene, 1,4-naphthylene, 2,2-biphenylene, 4,4'-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

These other arylene, alkarylene, alkylene and alkenylene moieties can be unsubstituted or can have at least one $-SO_3M$,—COOM or $-A-R^7-[A-R^1-A-R^7-O]_wX$ substituent or at least one moiety $-A-R^7-[A-R^1-A-R^7]_wA-$ cross-linked to another $R^1$ moiety, wherein $R^7$ is the moiety $R^2$ or $R^3$; and w is 0 or at least 1. Preferably, these substituted $R^1$ moieties have only one $-SO_3M$, —COOM or $-A-R^7-[A-R^1-A-R^7-O]_wX$ substituent. M can be H or any compatible water-soluble cation. Suitable water-soluble cations include the water-soluble alkali metals such as potassium ($K^+$) and especially sodium ($Na^+$), as well as ammonium ($NH_4^+$). Also suitable are substituted ammonium cations having the formula:

$$R^2-\overset{\overset{R^1}{|}}{\underset{\underset{R^3}{|}}{N^+}}-R^4$$

where $R^1$ and $R^2$ are each a $C_1$–$C_{20}$ hydrocarbyl group (e.g. alkyl, hydroxyalkyl) or together form a cyclic or heterocyclic ring of from 4 to 6 carbon atoms (e.g. piperidine, morpholine); $R^3$ is a $C_1$–$C_{20}$ hydrocarbyl group; and $R^4$ is H (ammonium) or a $C_1$–$C_{20}$ hydrocarbyl group (quat amine). Typical substituted ammonium cationic groups are those where $R^4$ is H (ammonium) or $C_1$–$C_4$ alkyl, especially methyl (quat amine); $R^1$ is $C_{10}$–$C_1B$ alkyl, especially $C_{12}$–$C_{14}$ alkyl; and $R^2$ and $R^3$ are each $C_1$–$C_4$ alkyl, especially methyl.

The $R^1$ moieties having $-A-R^7-[A-R^1-A-R^7-O]_wX$ substituents provide branched backbone compounds. The $R^1$ moieties having $-A-R^7-[A-R^1-A-R^7]_wA-$ moieties provide cross-linked backbone compounds. Indeed, syntheses used to make the branched backbone compounds typically provide at least some cross-linked backbone compounds.

For the $R^1$ moieties, the degree of partial substitution with moieties other than 1,4-phenylene should be such that the soil release properties of the compound are not adversely affected to any great extent. Generally, the degree of partial substitution. which can be tolerated will depend upon the backbone length of the compound, i.e., longer backbones can have greater partial substitution for 1,4-phenylene moieties. Usually, compounds where the $R^1$ comprise from about 50 to 100% 1,4-phenylene moieties (from 0 to about 50% moieties other than 1,4-phenylene) have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e. each $R^1$ moiety is 1,4-phenylene.

The $R^2$ moieties are essentially substituted ethylene moieties having $C_1$–$C_4$alkyl or alkoxy substitutents. As used herein, the term "the $R_2$ moieties are essentially substituted ethylene moieties having $C_1$–$C_4$ alkyl or alkoxy substituents" refers to compounds of the present invention where the $R^2$ moieties consist entirely of substituted ethylene moieties, or are partially replaced with other compatible moieties. Examples of these other moieties include linear $C_2$–$C_6$ alkylene moieties such as ethylene, 1,3-propylene, 1,4-butylene, 1,5-pentylene or 1,6-hexamethylene, 1,2-cycloalkylene moieties such as 1,2-cyclohexylene, 1,4-cycloalkylene moieties such as 1,4-cyclohexylene and 1,4-dimethylene-cyclohexylene, polyoxyalkylated 1,2-hydroxyalkylenes such as $$-\underset{\underset{CH_2-O(CH_2CH_2O)_p-X}{|}}{CH_2-CH}- \quad ,$$

and oxyalkylene moieties such as $-CH_2CH_2OCH_2CH_2-$.

For the $R^2$ moieties, the degree of partial replacement with these other moieties should be such that the soil release and solubility properties of the compounds are not adversely affected to any great extent. Generally, the degree of partial replacement which can be tolerated will depend upon the soil release and solubility properties desired, the backbone length of the compound, (i.e., longer backbones generally can have greater partial replacement), and the type of moiety involved (e.g., greater partial substitution with ethylene moieties generally decreases solubility). Usually, compounds where the $R^2$ comprise from about 20 to 100% substituted ethylene moieties (from 0 to about 80% other compatible moieties) have adequate soil release activity. However, it is generally desirable to minimize such partial replacement for best soil release activity and solubility properties. (During the making of polyesters according to the present invention, small amounts of oxyalkylene moieties (as dialkylene glycols) can be formed from glycols in side reactions and then incorporated into the polyester). Preferably, $R^2$ comprises from about 80 to 100% substituted ethylene moieties, and from 0 to about 20% other compatible moieties. For the $R^2$ moieties, suitable substituted ethylene moieties include 1,2-propylene, 1,2-butylene, 3-methoxy-1,2-propylene and mixtures thereof. Preferably, the $R^2$ moieties are essentially 1,2-propylene moieties.

The $R^3$ moieties are essentially the polyoxyethylene moiety $-(CH_2CH_2O)_q-CH_2CH_2-$. As used herein, the term "the $R^3$ moieties are essentially the polyoxyethylene moiety $-(CH_2CH_2O)_q-H_2CH_2-$" refers to compounds of the present invention in which the $R^3$ moieties consist entirely of this polyoxyethylene moiety, or further include other compatible moieties. Examples of these other moieties include $C_3$–$C_6$ oxyalkylene moieties such as oxypropylene and oxybutylene, polyoxyalkylene moieties such as polyoxypropylene and polyoxybutylene, and polyoxyalkylated 1,2-hydroxyalkylene oxides such as $$-OCH_2\underset{\underset{CH_2O(CH_2CH_2O)_p-X}{|}}{CH}-$$

The degree of inclusion of these other moieties should be such that the soil release properties of the compounds are not adversely affected to any great extent. Usually, in compounds of the present invention, the polyoxyethylene moiety comprises from about 50 to 100% of each $R^3$ moiety. Preferably, the polyoxyethylene moiety comprises from about 90 to 100% of each $R^3$ moiety. (During the making of polyesters according to the present invention, very small amounts of oxyalkylene moieties may be attached to the polyoxyethylene moiety in side reactions and thus incorporated into the $R^3$ moieties).

For the polyoxyethylene moiety, the value for q is at least about 9, and is preferably at least about 12. The value for q usually ranges from about 12 to about 180. Typically, the value for q is in the range of from about 12 to about 90.

The moieties $-(R^4O)-$ and $-(CH(Y)CH_2O)-$ of the moieties $-[(R^4O)_m(CH(Y)CH_2O)_n]-$ and $-[(OCH(Y)CH_2)_n(OR^4)_m]-$ can be mixed together or preferably form blocks of $-(R^4O)-$ and $-(CH(Y)CH_2O)-$ moieties. Preferably, the blocks of $-(R^4O)-$ moieties are located next to the backbone of the compound. When $R^4$ is the moiety $-R^2-A-R^5-$, m is 1; also the moiety $-R^2-A-R^5-$ is preferably located next to the backbone of the compound. For $R^4$, the preferred $C_3$–$C_4$ alkylene is $C_3H_6$ (propylene); when $R^4$ is $C_3$–$C_4$ alkylene, m is preferably from 0 to about 10 and is most preferably 0. $R^5$ is preferably methylene or 1,4-phenylene. The moiety $-(CH(Y)CH_2O)-$ preferably comprises at least about 75% by weight of the moiety $-[(R^4O)_m(CH(Y)CH_2O)_n]-$ and most preferably 100% by weight (m is 0).

The Y substituents of each moiety $[(R^5O)_m(CH(Y)CH_2O)_n]$ are H, the ether moiety $-CH_2(OCH_2CH_2)_pO-X$, or a mixture of this ether moitey and H; p can range from 0 to 100, but is typically 0. Typically, the Y substituents are all H. When the Y substituents are a mixture of the ether moiety and H, the moiety $-(CH(Y)CH_2O)_n-$ can be represented by the following moiety:

$$+\underset{\underset{CH_2(OCH_2CH_2)_pO-X}{|}}{(CHCH_2O)_{n_1}}(CH_2CH_2O)_{n_2}+$$

wherein $n_1$ is at least 1 and the sum of $n_1+n_2$ is the value for n. Typically, $n_1$ has an average value of from about 1 to about 10. The moieties $$-\underset{\underset{CH_2(OCH_2CH_2)_pO-X}{|}}{(CHCH_2O)_{n_1}}- \quad \text{and} \quad -(CH_2CH_2O)_{n_2}-$$

can be mixed together, but typically form blocks of $$-\underset{\underset{CH_2(OCH_2CH_2)_pO-X}{|}}{(CHCH_2O)_{n_1}}- \quad \text{and} \quad -(CH_2CH_2O)_{n_2}\text{-moieties.}$$

X can be H, $C_1$–$C_4$ alkyl or $$-\overset{O}{\overset{||}{C}}R^7,$$

wherein $R^7$ is $C_1$–$C_4$ alkyl. X is preferably methyl or ethyl, and most preferably methyl. The value for each n is at least about 6, but is preferably at least about 10. The value for each n usually ranges from about 12 to about 113. Typically, the value for each n is in the range of from about 12 to about 45.

The backbone moieties $-(A-R^1-A-R^2)-$ and $-(A-R^1-A-R^3)-$ can form blocks of $-(A-R^1-A-R^2-)$ and $-(A-R^1-A-R^3)-$ moieties but are more typically randomly mixed together. For these backbone moieties, the average value of u can range from about 2 to about 50; the average value of v can range from about 1 to about 20; and the average value of u+v can range from about 3 to about 70. The average values for u, v and u+v are generally determined by the process by which the compound is made. Generally, the larger the average value for v or the smaller the average value for u+v, the more soluble is the compound. Typically, the average value for u is from about 5 to about 20; the average value for v is from about 1 to about 10; and the average value for u+v is from about 6 to about 30. Generally, the ratio of u to v is at least about 1 and is typically from about 1 to about 6.

Preferred compounds in this class of polymers are polyesters having the formula:

$$X-(OCH_2CH_2)_n-[(\overset{O}{\overset{||}{C}}-R^1-\overset{O}{\overset{||}{C}}-R^2)_u(\overset{O}{\overset{||}{C}}-R^1-\overset{O}{\overset{||}{C}}-R^3)_v]-\overset{O}{\overset{||}{C}}-R-\overset{O}{\overset{||}{C}}-(CH_2CH_2O)_n-X$$

wherein each $R^1$ is a 1,4-phenylene moiety; the $R^2$ are essentially 1,2-propylene moieties; the $R^3$ are essentially the polyoxyethylene moiety $-(CH_2H_2O)_q-CH_2CH_2-$; each X is ethyl or preferably methyl; each n is from about 12 to about 45; q is from about 12 to about 90; the average value of u is from about 5 to about 20; the average value of v is from about 1 to about 10; the average value of u+v is from about 6 to about 30; the ratio u to v is from about 1 to about 6.

Highly preferred polymers for use herein are polymers of the formula:

$$X(OCH_2CH_2)_n(O-\overset{O}{\overset{||}{C}}-R^1-\overset{O}{\overset{||}{C}}-OR^2)_u(O-\overset{O}{\overset{||}{C}}-R^1-\overset{O}{\overset{||}{C}}-O)(CH_2CH_2O)_nX$$

in which X can be any suitable capping group, with each X being selected from the group consisting of H, and alkyl or acyl groups containing from 1 to about 4 carbon atoms, preferably 1 to 2 carbon atoms. most preferably alkyl. n is selected for water solubility and is a range of values which generally averages from about 10 to about 50, preferably from about 10 to about 25. The selection of u is critical to formulation in a liquid detergent having a relatively high ionic strength. There should be very little material, preferably less than about 10 mol %, more preferably less than 5 mol %, most preferably less than 1 mol %, in which u is greater than 5. Furthermore there should be at least 20 mol %, preferably at least 40 mol %, of material in which u ranges from 3 to 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties. or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4'-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e. each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, or, preferably, 1,2-propylene moieties or mixtures thereof. Although inclusion of a greater percentage of ethylene moieties tends to improve the soil release activity of the compounds, the percentage included is limited by water solubility. Surprisingly, inclusion of a greater percentage of 1,2-propylene moieties tends to improve the water solubility of the compounds and consequently the ability to formulate isotropic aqueous detergent compositions without significantly harming soil release activity.

For this invention, the use of 1,2-propylene moieties or a similar branched equivalent is extremely important for maximizing incorporation of a substantial percentage of the soil release component in the heavy duty liquid detergent compositions. Preferably, from about 75% to about 100%, mere preferably from about 90% to about 100% of the $R^2$ moieties are 1,2-propylene moieties.

In general, soil release components which are soluble in cool (15° C.) ethanol are also useful in compositions of the invention.

The value for n averages at least about 10, but a distribution of n values is present. The value for each n usually ranges from about 10 to about 50. Preferably, the value for each n averages in the range of from about 10 to about 25.

A preferred process for making the soil release component comprises the step of extracting a polymer having a typical distribution in which a substantial portion comprises a material in which u is equal to or greater than 6 with essentially anhydrous ethanol at low temperatures, e.g. from about 10° C. to about 15° C., preferably less than about 13° C. The ethanol soluble fraction is substantially free of the longer polymers and is much easier to incorporate into isotropic heavy duty liquids, especially those with higher builder levels. Although the polymers wherein u is less than about 3 are essentially of no value in providing soil release effects, they can be mere easily incorporated than higher u values.

A more preferred process for making the soil release component is by direct synthesis.

A more comprehensive disclosure of the soil release component and methods for making it can be found in copending U.S. patent application, Ser. No. 684, 511, filed Dec. 21, 1984 by Eugene P. Gosselink, incorporated herein by reference. The most preferred polymers for use herein are polymers according to the formula:

$$X(OCH_2CH_2)_n(O-\overset{O}{\overset{\|}{C}}-R^1-\overset{O}{\overset{\|}{C}}-OR^2)_u$$

$$(O-\overset{O}{\overset{\|}{C}}-R^1-\overset{O}{\overset{\|}{C}}-O)(CH_2CH_2O)_nX$$

wherein X is methyl, n is 16, $R^1$ is 1,4-phenylene moiety, $R^2$ is 1,2-propylene moiety and u is essentially between 3 and 5.

DETERGENT ADJUNCTS

The present compositions are conveniently used as additives to conventional detergent compositions for use in laundry operations. The present invention also encompasses dye transfer inhibiting compositions which will contain detergent ingredients and thus serve as detergent compositions.

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $$R^2-\underset{\underset{O}{\|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein. Suitable builders can be an inorganic ion exchange material, commonly an inorganic hydrated aluminosilicate material, more particularly a hydrated synthetic zeolite such as hydrated zeolite A, X, B or HS. Another suitable inorganic builder material is layered silicate, e.g. SKS-6 (Hoechst). SKS-6 is a crystalline layered silicate consisting of sodium silicate ($Na_2Si_2O_5$). Suitable polycarboxylates builders for use herein include citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate2-dodecenylsuccinate, 2-tetradecenyl succinate. Succinate builders are preferably used in the form of their water-soluble salts, including sodium, potassium, ammonium and alkanolammonium salts. Other suitable polycarboxylates are oxodisuccinates and mixtures of tartrate monosuccinic and tartrate disuccinic acid such as described in U.S. Pat. No. 4,663,071. Especially for the liquid execution herein, suitable fatty acid builders for use herein are saturated or unsaturated C10–18 fatty acids, as well as well as the corresponding soaps. Preferred saturated species have from 12 to 16 carbon atoms in the alkyl chain. The preferred unsaturated fatty acid is oleic acid. Preferred builder systems for use in granular compositions include a mixture of a water-insoluble aluminosilicate builder such as zeolite A, and a watersoluble carboxylate chelating agent such as citric acid. Other builder materials that can form part of the builder system for use in granular compositions the purposes of the invention include inorganic materials such as alkali metal carbonates, bicarbonates, silicates, and organic materials such as the organic phosphonates, amino polyalkylene phosphonates and amino polycarboxylates. Other suitable water-soluble organic salts are the homo- or co-polymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Other components used in detergent compositions may be employed, such as bleaches, suds boosting or depressing agents, enzymes and stabilizers or activators therefor, soil-suspending agents soil-release agents, optical brighteners, abrasives, bactericides, tarnish inhibitors, coloring agents, and perfumes. Especially preferred are combinations with technologies which also provide a type of color care benefit. Examples of these technologies are polyvinylpyrrolidone polymers and other polymers which have dye transfer inhibiting properties. Another example of said technologies are cellulase for color maintenance/rejuvenation.

The detergent compositions according to the invention can be in liquid, paste or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid .compositions according to the present invention can also be in "compact form", in such case, the liquid detergent compositions according to the present invention will contain a lower amount of water, compared to conventional liquid detergents.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. The pH of the treatment solution is preferably from 7 to 11, especially from 7.5 to 10.5.

The process and compositions of the invention can also be used as additive during laundry operations.

The following examples are meant to exemplify compositions of the present invention, but are not necessarily meant to limit or otherwise define the scope of the invention, said scope being determined according to claims which follow.

EXAMPLE I

A liquid detergent composition according to the present invention is prepared, having the following composition:

| | |
|---|---|
| Linear alkylbenzene sulfonate | 10 |
| Alkyl sulphate | 4 |
| Fatty alcohol ($C_{12}$–$C_{15}$) ethoxylate | 12 |
| Fatty acid | 10 |
| Oleic acid | 4 |
| Citric acid | 1 |
| NaOH | 3.4 |
| Propanediol | 1.5 |
| Ethanol | 10 |
| Poly(4-vinylpyridine)-N-oxide | 0.3 |
| Therephtalate-based polymer | 0.4 |
| Minors | up to 100 |

EXAMPLE II

A compact granular detergent composition according to the present invention is prepared, having the following formulation:

| | |
|---|---|
| Linear alkyl benzene sulphonate | 11.40 |
| Tallow alkyl sulphate | 1.80 |
| $C_{45}$ alkyl sulphate | 3.00 |
| $C_{45}$ alcohol 7 times ethoxylated | 4.00 |
| Tallow alcohol 11 times ethoxylated | 1.80 |
| Dispersant | 0.07 |
| Silicone fluid | 0.80 |
| Trisodium citrate | 14.00 |
| Citric acid | 3.00 |
| Zeolite | 32.50 |
| Maleic acid actylic acid copolymer | 5.00 |
| DETMPA | 1.00 |
| Cellulase (active protein) | 0.03 |
| Alkalase/BAN | 0.60 |
| Lipase | 0.36 |
| Sodium silicate | 2.00 |
| Sodium sulphate | 3.50 |
| Glucose | 10.00 |
| Poly(4-vinylpyridine)-N-oxide | 0.3 |
| Terephtalate-based polymer | 0.4 |
| Minors | up to 100 |

EXAMPLES III–VI

The compositions according to the present invention will be further illustrated by the following examples. The following liquid detergent compositions are made by mixing the listed ingredients in the listed proportions (weight %). These compositions comprise a pH-jump system which consists of polyhydroxy fatty acid amide surfactants and borate and/or propanediol. The compositions are formulated at a pH below 7, preferably at a pH of 6.5. Upon dilution, these formulations provide a wash pH of at least 7.4. This pH-jump allows compositions which are unstable at a certain pH to be formulated at a lower pH. Examples of such compositions are polymer-containing compositions which have a better stability of the polymers at a lower pH. Other advantages of the pH-jump system include the improved bleachable stain removal upon pretreatment and lower formulation cost, in that less neutralizing agent is required to obtain a higher pH.

| | III | IV | V | VI |
|---|---|---|---|---|
| $C_{12}$–$C_{15}$ Alkyl sulfate | — | 19.0 | 21.0 | — |
| $C_{12}$–$C_{15}$ Alkyl ethoxylated sulfate | 23.0 | 4.0 | 4.0 | 25.0 |
| $C_{12}$–$C_{14}$ N-methyl glucamide | 9.0 | 9.0 | 9.0 | 9.0 |
| $C_{12}$–$C_{14}$ fatty alcohol ethoxylate | 6.0 | 6.0 | 6.0 | 6.0 |
| $C_{12}$–$C_{16}$ Fatty acid | 9.0 | 6.8 | 14.0 | 14.0 |
| citric acid anhydrous | 6.0 | 4.5 | 3.5 | 3.5 |
| Diethylene triamine penta methylene phosphonic acid | 1.0 | 1.0 | 2.0 | 2.0 |
| Monoethanolamine | 13.2 | 12.7 | 12.8 | 11.0 |
| Propanediol | 12.7 | 14.5 | 13.1 | 10.0 |
| Ethanol | 1.8 | 1.8 | 4.7 | 5.4 |
| Enzymes | 2.4 | 2.4 | 2.0 | 2.0 |
| Terephtalate-based polymer | 0.5 | 0.5 | 0.5 | 0.5 |
| Polyvinyl pyrrolidone | 1.0 | 1.0 | — | — |
| Poly(4-vinylpyridine)-N-oxide | | | 0.5 | 0.5 |
| Boric acid | 2.4 | 2.4 | 2.8 | 2.8 |
| 2-butyl-Octanol | 2.0 | 2.0 | 2.0 | 2.0 |
| DC 3421 R (1) | 0.3 | 0.4 | 0.3 | 0.4 |
| FF 400 R (2) | | | | |
| Water & Minors | up to 100% | | | |

(1) DC 3421 is a silicone oil commercially available from Dow Corning.
(2) is a silicone glycol emulsifier available from Dow Corning.

We claim:

1. A detergent composition comprising:

a) a polyamine N-oxide containing polymer which is Poly(4-vinylpyridine)-N-oxide; and, b) a terephthalate polymer; and, wherein said polyamine N-oxide containing polymer is present at a level of from about 0.01% to about 10% by weight of said detergent composition, and wherein said terephthalate polymer is present at a level of from about 0.01% to about 10% by weight of said detergent composition.

2. A detergent composition according to claim 8, wherein said polyamine N-oxide polymer has an average molecular weight within the range of about 500 to about 1,000,000.

3. A detergent composition according to claim 8, wherein said polyamide N-oxide polymer has an average molecular weight within the range of about 1,000 to about 500,000.

4. A detergent composition according to claim 8, wherein said polyamide N-oxide polymer has an average molecular weight within the range of about 5,000 to about 100,000.

5. A detergent composition according to claim 8, wherein said terephthalate polymer has the structure:

$$X—[(OCH_2CH(Y))_n(OR^5)_m]—[(A—R^{1-}A—R^2)_u(A—R^3—A—R^2)_v]—A—R^4—A—[(R^5O)_m(CH(Y)CH_2O)_n]—X;$$

wherein A is selected from the group consisting of:

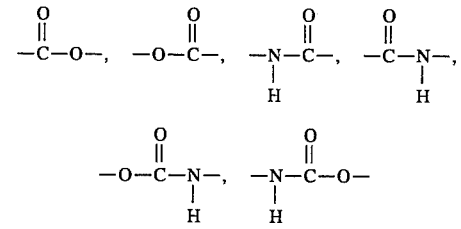

or mixtures thereof;

$R^1$ is selected from the group consisting of 1,4-phenylene, arylene, alkarylene, alkylene, alkenylene, and mixtures thereof;

$R^2$ is selected from the group consisting of substituted ethylene having $C_1$–$C_4$ alkyl or alkoxy substituents and mixtures thereof;

$R^3$ is selected from the group consisting of linear, branched or cyclic substituted $C_2$–$C_{18}$ hydrocarbylene;

$R^4$ is selected from the group consisting of 1,4-phenylene, arylene, alkarylene, alkylene, alkenylene, linear, branched or cyclic substituted $C_2$–$C_{18}$ hydrocarbylene and mixtures thereof;

$R^5$ is selected from the group consisting of ethylene having $C_1$–$C_4$ alkyl or alkoxy substituents, group A substituents, methylene, 1,4-phenylene, and mixtures thereof;

Y is selected from the group consisting of the ether moiety $—CH_2(OH_2CH_2)_pO—X$, wherein P is from 0 to 100, H, and mixtures thereof;

X is selected from the group consisting H, $C_1$–$C_4$ alkyl, and $—C—R^7$, wherein $R^7$ is $C_1$–$C_4$ alkyl;

n is a number in the range of 6 to 113;

m is a number in the range of 0 to 5; and the total of u+v is in the range of about 3 to 25.

6. A detergent composition according to claim 5, wherein said terephthalate polymer is a block polyester of the formula:

$$X-[(OCH_2CH_2)_n(OCH_2\underset{\underset{CH_2OX}{|}}{CH})_m]-[(\overset{\overset{O}{||}}{C}-R^1-\overset{\overset{O}{||}}{C}O-R^2)_u(-\overset{\overset{O}{||}}{C}-R^3-\overset{\overset{O}{||}}{C}O-R^2)_v]-\overset{\overset{O}{||}}{C}-R^4-\overset{\overset{O}{||}}{C}O-[(\underset{\underset{CH_2OX}{|}}{CH}CH_2O)_m(CH_2CH_2O)_n]-X;$$

wherein the sum of n+m is from 12–43.

* * * * *